United States Patent [19]

Rothanavibhata et al.

[11] Patent Number: 4,715,969

[45] Date of Patent: Dec. 29, 1987

[54] CONTROLLING VISCOSITY OF FABRIC SOFTENING HEAVY DUTY LIQUID DETERGENT CONTAINING BENTONITE

[75] Inventors: Adam A. Rothanavibhata, East Brunswick; Richard K. Payne, Sayreville, both of N.J.

[73] Assignee: Colgate Palmolive Co., New York, N.Y.

[21] Appl. No.: 889,147

[22] Filed: Jul. 23, 1986

Related U.S. Application Data

[63] Continuation of Ser. No. 685,346, Dec. 24, 1984, abandoned.

[51] Int. Cl.[4] ..... D06M 11/00

[52] U.S. Cl. ..... 252/8.7; 252/8.6; 252/174.24; 252/539; 252/558

[58] Field of Search ..... 252/8.6, 8.7, 174.24, 252/539, 558

[56] References Cited

U.S. PATENT DOCUMENTS

| | | | |
|---|---|---|---|
| 3,254,028 | 5/1966 | Wixon | 252/524 |
| 3,579,455 | 5/1971 | Sabatelle et al. | 252/174.24 |
| 3,951,826 | 4/1976 | Rasmussen | 252/8.9 |
| 4,436,637 | 3/1984 | Ramachandran et al. | 252/8.7 |
| 4,469,605 | 9/1984 | Ramachandran et al. | 252/8.7 |
| 4,472,287 | 9/1984 | Ramachandran et al. | 252/8.7 |
| 4,490,271 | 12/1984 | Spadini et al. | 252/174.24 |
| 4,619,774 | 10/1986 | Ramachandran et al. | 252/558 |

*Primary Examiner*—Paul Lieberman
*Assistant Examiner*—Willie J. Thompson
*Attorney, Agent, or Firm*—B. Lieberman; M. M Grill; H. S. Sylvester

[57] ABSTRACT

A fabric softening heavy duty liquid detergent composition of controlled viscosity, which does not thicken excessively on aging, includes certain proportions of sodium linear higher alkylbenzene sulfonate, sodium alkyl polyethoxy sulfate, builder salt (highly preferably a mixture of sodium tripolyphosphate and sodium carbonate), finely divided swelling bentonite, low molecular weight polyacrylate and water. Such product is a stable pourable liquid of desired viscosity, density and pH, convenient for use in washing machines, for hand washing of laundry and for pre-treatment of badly soiled portions of items to be laundered. The presence of a small percentage of the polyacrylate in the composition prevents the viscosity thereof from increasing on storage to such an extent as would interfere with pourability.

7 Claims, No Drawings

CONTROLLING VISCOSITY OF FABRIC SOFTENING HEAVY DUTY LIQUID DETERGENT CONTAINING BENTONITE

This is a continuation of application Ser. No. 685,346, filed Dec. 24, 1984, now abandoned.

This invention relates to a fabric softening heavy duty liquid detergent composition. More particularly, it relates to such a liquid composition which comprises described synthetic organic detergent and builder components together with a swelling bentonite and a low molecular weight polyacrylate in an aqueous medium. The product of the invention is of an improved stable viscosity or thickness even after being stored for a month, is readily pourable and is a good laundry composition and fabric softener.

Heavy duty liquid detergents, useful for machine washing of laundry, have been marketed and have been described in various patents and in the literature. Bentonite has been included in particulate detergent compositions as a fabric softener and has been utilized in aqueous compositions as a thickener, which can help to maintain insoluble particulate materials, such as abrasives, suspended in a liquid medium. In U.S. Pat. No. 4,469,605 (Ramachandran and Grand) bentonite was successfully employed in the manufacture of what was then considered to be an acceptable stable fabric softening heavy duty liquid detergent in which the bentonite was the fabric softening component. It has now been learned that the detergent compositions described in that patent while stable and relatively constant in viscosity on storage when made in the laboratory and pilot plant, often thicken on storage when made with production equipment.

In accordance with the present invention a fabric softening heavy duty liquid composition of a density in the range of 1.15 to 1.35 g./ml. at room temperature, a pH in the range of 9.5 to 11, and a viscosity in the range of 1,000 to 5,000 centipoises, which does not increase to more than 5,000or 6,000 cps. on 30 days quiescent storage at room temperature, comprises 5 to 15% of alkali metal linear or branched higher alkylbenzene sulfonate wherein the higher alkyl is of 10 to 16 carbon atoms, 1.5 to 5% of alkali metal alkyl polyethoxy sulfate wherein the alkyl is of 10 to 16 carbon atoms and the polyethoxy is of 2 to 11 ethylene oxide groups, 5 to 25% of water soluble builder salt, 5 to 20% of a swelling bentonite, 0.1 to 0.3% 0.05 to 0.5% of water soluble polyacrylate of a molecular weight in the range of 1,000 to 5,000, and 40 to 75% of water. The described liquid detergent is a commercially acceptable heavy duty laundry detergent, capable of satisfactorily cleaning laundry items containing both oily and particulate soils and simultaneously depositing on such laundry items sufficient bentonite to soften them appreciably. The described compositions may also be employed for the pre-treatment of badly soiled areas, such as collars and cuffs, of items to be laundered, in which treatment the presence of the bentonite in the liquid, which may be applied directly to the soiled areas, with some rubbing, is considered to be useful in mechanically assisting in loosening and/or removing the soil.

The synthetic anionic organic detergent mixture present in the liquid detergents of this invention is a mixture of linear or branched (preferably linear) higher alkylbenzene sulfonate and alkyl polyethoxy sulfate. While other water soluble linear higher alkylbenzene sulfonates may also be present in the instant formulas, such as potassium salts and in some instances the ammonium and/or alkanolammonium salts, where appropriate, it has been found that the sodium salt is highly preferred, which is also in the case with respect to the alkyl polyethoxy sulfate detergent component. The alkylbenzene sulfonate is one wherein the higher alkyl is of 12 to 16 carbon atoms, preferably 12 to 15, more preferably 12 to 13, and most preferably 13 carbon atoms. The alkyl polyethoxy sulfate, which also may be referred to as a sulfated polyethoxylated higher linear alcohol or the sulfated condensation product of a higher fatty alcohol and ethylene oxide or polyethylene glycol, is one wherein the alkyl is of 10 to 16 carbon atoms, preferably 12 to 15 carbon atoms, e.g., about 13 carbon atoms, and which includes 2 to 11 ethylene oxide groups, preferably 2 to 7, more preferably 3 to 5 and most preferably 3 or about 3 ethylene oxide groups. In suitable circumstances other anionic detergents, such as fatty alcohol sulfates, paraffin sulfonates, olefin sulfonates, monoglyceride sulfates, sarcosinates, sulfosuccinates and similarly functioning detergents, preferably as the alkali metal, e.g., sodium, salts, can be present, sometimes in partial replacement of the previously mentioned synthetic organic detergents but usually, if present, in addition to such detergents. Normally such other detergents will be sulfated or sulfonated products (usually as the sodium salts) and will contain long chain (8 to 20 carbon atoms) linear or fatty alkyl groups. In addition to any such other or supplementing anionic synthetic organic detergents there also may be present nonionic and amphoteric materials, such as the Neodols ®, sold by Shell Chemical Company, which are condensation products of ethylene oxide and higher fatty alcohols, e.g., Neodol 23-6.5, which is a condensation product of a higher fatty alcohol of about 12 to 13 carbon atoms with about 6.5 mols of ethylene oxide. Illustrations of the various detergents and classes of detergents mentioned may be found in the text *Surface Active Agents,* Vol. II, by Schwartz, Perry and Berch (Interscience Publishers, 1958), and in a series of annual publications entitled *McCutcheon's Detergents and Emulsifiers,* for example, that which was issued in 1969, the descriptions of which are incorporated herein by reference.

The builder salt combination of this invention, which has been found to satisfactorily improve detergency of the mixture of synthetic anionic organic detergents, which produces the desired pH in the liquid detergent and in the wash water, and which coacts with the detergent and the bentonite in the washing and softening process, is a mixture of sodium tripolyphosphate and sodium carbonate. Although in some instances incompletely neutralized tripolyphosphate may be used, normally the phosphate employed may be considered as being pentasodium tripolyphosphate, $Na_5P_3O_{10}$. Of course, in some instances, as when potassium salts of other materials are present, ion interchange in an aqueous medium may result in other salts than the sodium tripolyphosphate being present but for the purpose of this specification it will be considered that sodium tripolyphosphate, as the pentasodium salt, the material which is normally charged to the mixer to make the present liquid detergent, is the tripolyphosphate employed.

Other preferred builder salts which may be used in place of sodium tripolyphosphate and sodium carbonate or in addition thereto include sodium citrate and potassium citrate, and sodium nitrilotriacetate (NTA). The corresponding potassium salts may be used in partial replacements of these other builder salts, too. Of course, various mixtures of the mentioned water soluble builder salts can be utilized. The tripolyphosphate-carbonate mixture described has been found to be most preferred, although the other builders, and mixtures thereof, are also operative. Still other builders may be employed as supplements, in addition to the proportions of the above mentioned builders, subsequently to be described herein. Thus, other phosphates, such as tetrasodium pyrophosphate or tetrapotassium pyrophosphate, sodium bicarbonate, sodium sesquicarbonate, sodium gluconate, borax, sodium silicate, and sodium sesquisilicate, may be employed. Also, useful may be the polyacetal carboxylate builders, which are described in U.S. Pat. No. 4,144,226 and other related Monsanto Company patents, which are available under the trade name Builder U. Among the water insoluble builders that may be used are the zeolites, such as Zeolite A, usually in the form of its crystalline hydrate, although amorphous zeolites may also be useful. It is a feature of this invention that sodium silicate is not needed to make an effective heavy duty detergent-softener composition and therefore such silicate will usually be omitted from the present formulas, and any undesirable properties it may possess will therefore be avoided. For example, any tendency for silicate to react with other components of the liquid detergent, such as zeolite, sodium carbonate, or other builder, to produce insoluble material which may tend to adhere to the laundry and thereby adversely affect the desirable bright colors of such laundry, will be avoided. The absence of silicate in the detergent medium also prevents formation of insoluble siliceous decomposition products of the silicate, which could tend to adversely affect the appearance of the liquid detergent and the laundry if such became apparent in the liquid detergent or were deposited on the laundry.

The bentonite employed is a colloidal clay (aluminum silicate) containing montmorillonite. The type of bentonite which is most useful in making the invented base beads is that which is known as sodium bentonite (or Wyoming or Western bentonite), which is normally of a light to cream color or may be a tannish impalpable powder which, in water, can form a colloidal suspension having strongly thixotropic properties. In many instances a potassium bentonite or a mixed sodium potassium bentonite may be used instead. In water the swelling capacity of such clay will usually be in the range of 3 to 15 or 20 ml./gram, preferably 7 to 15 ml./g., and its viscosity, at 6% concentration in water, will usually be in the range of 3 to 30 centipoises, preferably 8 to 30 centipoises. Preferred swelling bentonites of this type are sold under the trade name Mineral Colloid, as industrial bentonites, by Benton Clay Company, a principal supplier of clays to industry. These materials, which are the same as those formerly sold under the trademark THIXO-JEL, are selectively mined and beneficiated bentonites, and those considered to be most useful are available as Mineral Colloid No's. 101, etc., corresponding to THIXO-JEL's No's. 1, 2, 3 and 4. Such materials have pH's (6% concentration in water) in the range of 8 to 9.4, maximum free moisture contents (before addition to the liquid detergent medium) of 4% to 8% and specific gravities of about 2.6. For the pulverized grade of such materials at least about 85% will pass through a 200 mesh U.S. Sieve Series sieve. Preferably all the bentonite will pass through a 200 mesh sieve and most preferably all of it will pass through or be about the size that will just pass through a No. 325 sieve, so that the equivalent diameter of the bentonite may be considered as being less than 74 microns and more preferably about or less than 44 microns. A useful commercial source of finely divided bentonite of satisfactory color is American Colloid Company and of their available bentonites that sold as AEG 325 bentonite is considered to be interchangeable with the previously mentioned Mineral Colloid's and THIXO-JEl's. Although beneficiated Wyoming bentonite is preferred as a component of the present liquid detergent compositions, other bentonites, including the synthetic bentonites (those made from bentonites having exchangeable calcium and/or magnesium, by sodium carbonate treatment) are also useful and are intended to be included in compositions of this invention. Typical chemical analyses of some bentonites that are useful for making the present liquid detergents show that they contain from 64.8 to 73.0% of $SiO_2$, 14 to 18% of $Al_2O_3$, 1.6 to 2.7% of MgO, 1.3 to 3.1% of CaO, 2.3 to 3.4% of $Fe_2O_3$, 0.8 to 2.8% of $Na_2O$ and 0.4 to 7.0% of $K_2O$.

Employment of bentonite as a fabric softening agent in the present liquid detergent compositions has the advantage that the bentonite does not have to be dried, as in a spray dryer, and therefore the risk of losing the softening power of the bentonite, due to immobilization of the component plates thereof by overdrying, is avoided. Also, it is unnecessary to have the detergent composition of this invention of such a formulation as to promote quick disintegration of the detergent beads in the wash water to release the bentonite particles because in the liquid detergent such particles are not agglomerated into hard masses which could require additional time for disintegration.

The polyacrylate employed is a low molecular weight sodium polyacrylate, such molecular weight usually being within the range of about 1,000 to 5,000, preferably 1,000 to 3,000, and most preferably 1,500 to 2,500, e.g., about 2,000. The mean molecular weight will usually be within the range of 1,200 to 2,500, such as about 2,000. Although other polyacrylates may sometimes be substituted in part for the described sodium polyacrylate, including other alkali metal polyacrylates, it is preferred that such substitutions, when permitted, be limited to a minor proportion of the material, and preferably the polyacrylate employed will be sodium polyacrylate. Such materials are available from Alco Chemical Corporation under the name Alcosperse. The sodium polyacrylates are available as clear amber liquids or powders, completely soluble in water, with the solutions being of about 25 to 40% solids content, e.g., 30%, and with the pH of such solutions or of a 30% aqueous solution of the powder being in the range of about 7.0 to 9.5. Among these products those preferred are presently sold by Alco Chemical Corp. as Alcosperses 104, 107, 107D, 109 and 149, of which Alcosperse 107D, a 100% solids powder, is highly preferred, although Alcosperse 107, a 30% aqueous solution, may be used instead with little difference in results. Both are sodium polyacrylates with the liquid (107) being of a pH in the 8.5 to 9.5 range and the pH of the powder (107D) being in the 7.0 to 8.0 range, at a 30% concentration in water.

The only other required component of the present liquid detergents is water. Normally the hardness content of such water will be less than about 300 p.p.m. as $CaCO_3$, and preferably it will be less than 150 p.p.m.

Often it may be desirable to utilize deionized water although often city water with less than 50 or 100 p.p.m. hardness content will be about as satisfactory. While harder waters may be successfully employed in making the present liquid detergents it is considered that soft waters have less likelihood of producing some objectionable materials which could adversely affect the appearance of the liquid detergent or which could deposit objectionably on laundry during washing.

Various adjuvants both aesthetic and functional, may be present in the liquid detergents, such as fluorescent brighteners, perfumes and colorants. The fluorescent brighteners include the well known stilbene derivatives, including the cotton and nylon brighteners, such as those sold under the trademark Tinopal, e.g., 5BM. The perfumes that are employed usually include essential oils, esters, aldehydes and/or alcohols, all of which are known in the perfumery art. The colorants may include dyes and water dispersible pigments of various types, including ultramarine blue. Because of the lightening effect due to the presence of the bentonite in the liquid detergent, colors of the product may often be attractive pastels. Titanium dioxide may be utilized to lighten the color of the product further or to whiten it. Inorganic filler salts, such as sodium sulfate and sodium chloride may be present, as may be antiredeposition agents, such as sodium carboxymethylcellulose; enzymes; bleaches; bactericides; fungicides; antifoam agents, such as silicones; antisoiling agents, such as copolyesters; preservatives, such as formalin; foam stabilizers, such as lauric myristic diethanolamide; and auxiliary solvents, such as ethanol. Normally the individual proportions of such adjuvants will be less than 3%, often less than 1% and sometimes even less than 0.5%, except for any fillers and solvents, and additional detergents and builders, for which the proportions may sometimes be as high as 10%. The total proportion of adjuvants, including non-designated synthetic detergents and builders, will normally be no more than 20% of the product and desirably will be less than 10% thereof, more desirably less than 5% thereof. Of course, the adjuvants employed will be non-interfering with the washing and softening actions of the liquid detergent and will not promote instability of the product on standing. Also, they will not cause the production of objectionable deposits on the laundry.

The proportions of various components in the present liquid detergent will be within the range of 5 to 15%, preferably 6 to 12%, more preferably 8 to 10%, and most preferably about 9% of the sodium linear higher alkylbenzene sulfonate; 1.5 to 5%, preferably 1.5 to 3%, more preferably 1.7 to 2.7% and most preferably about 2% of the sodium alkylpolyethoxy sulfate; 5 to 25%, preferably 9 to 22%, and more preferably about 12 to 19% of builder salt; 5 to 20%, preferably 8 to 15%, more preferably 10 to 14%, and most preferably about 12% of swelling bentonite; and 40 to 75%, preferably 50 to 70%, more preferably 55 to 70%, and most preferably about 60% of water. Of the builder salts, when they are sodium tripolyphosphate and sodium carbonate, the proportions thereof will usually be 7 to 15%, preferably 9 to 13%, and more preferably about 11% of the tripolyphosphate, and 2 to 7%, preferably 3 to 6%, and more preferably about 4% of sodium carbonate; with the ratio of tripolyphosphate to carbonate being within the range of 2:1 to 6:1.

The liquid detergents may be made by appropriately mixing the various components thereof, preferably with the bentonite being added to a pre-mix of most of the water with tripolyphosphate, carbonate, CMC and anionic detergent. For example, the polyphosphate and carbonate, in finely divided form, normally sufficiently fine to pass a No. 160 screen, may be admixed with and dissolved in most of the water, after which the CMC and anionic detergent may be admixed, followed by bentonite, polyacrylate and the rest of the formula components, in any suitable order. The portion of the water held out is then added to the rest of the liquid detergent and causes thinning of the thickened liquid to a desired apparent viscosity.

Experience has shown that the desirable proportion of water to hold back and admix last in the manufacturing process is normally 5 to 20% of the final liquid detergent, e.g., about 10% thereof. During the mixing of the various components with the aqueous medium, and especially when the bentonite is added and the remaining water is admixed, it is important to maintain the mixture in motion, as by continuing to mix or stir it. Preferably, the mixer is never turned off and the process is continuous, normally taking about 3 to 30 minutes per batch. While the water may be warmed to promote dissolving of the various product components therein and to promote dispersing of the bentonite, such is not necessary and room temperature water, e.g., water at a temperature in the range of 15° to 30° C., such as 20° to 25° C., may be used.

The viscosity of the present liquid detergent immediately after completion of the manufacturing procedure is normally in the range of about 1,000 to 2,000 centipoises, e.g., about 1,500 cps. The liquid detergent is intended for packaging in and dispensing from comparatively narrow necked glass or plastic bottles, from which it must be pourable initially and after normal aging. When the polyacrylate is omitted from the formula it has been found that commercially manufactured liquid detergent is initially thicker and becomes more viscous on standing, so that after about a month of storage at room temperature its viscosity may have increased from about 3,000 cps. to over 18,000 cps. At 18,000 cps. the liquid detergent is too thick to be satisfactorily pourable and requires the consumer to shake it or stir it so as to thin it sufficiently so that it will be pourable from the bottle. Needless to say, such thickening characteristic is undesirable. The preferred viscosity for the present liquid detergent is about 4,000 cps.±1,000 cps., and viscosities like these are found to be those preferred by consumers. Utilizing the polyacrylate component and the formulas of the present invention, as will be exemplified in Example 1, it is found that after about a month's storage the viscosity has increased to about 4,000 cps. (4,050 cps. after 28 days) and further storage does not result in any significant further viscosity increase. The viscosities described are measured by means of a Brookfield LVT viscometer, utilizing a No. 2 spindle for viscosities less than 2,000 cps., a No. 3 spindle for viscosities in the range of 2,000 to 9,000 cps., and a No. 4 spindle for viscosities greater than 9,000 cps. All viscosities are measured at 12 r.p.m. and at 25° C.

The following examples illustrate but do not limit the invention. Unless otherwise indicated all parts are by weight and all temperatures are in °C. in this specification, including the working examples, and the claims.

EXAMPLE 1

| Components | Percent |
|---|---|
| Sodium linear tridecylbenzene sulfonate | 8.8 |
| Sodium alkyl polyethoxy sulfate (alkyl = linear alkyl of 12 to 15 carbon atoms; polyethoxy = 3 ethoxy groups) | 2.2 |
| Pentasodium tripolyphosphate | 11.0 |
| Sodium carbonate (anhydrous) | 4.0 |
| Sodium carboxymethyl cellulose | 0.2 |
| Sodium polyacrylate (M.W. = 2,000) | 0.15 |
| Titanium dioxide | 0.5 |
| Formalin | 0.2 |
| Bentonite (325 mesh, American Colloid Co. 325 AEG) | 12.0 |
| Fluorescent brightener (Tinopal LMS-X [CIBA-GEIGY]) | 0.3 |
| Perfume | 0.4 |
| Dye (CI Acid Blue 9/CI 42090) | 0.0045 |
| Pigment (CI Pigment Blue 29/CI 77007) | 0.04 |
| Water (deionized) | 60.7055 |
| | 100.0 |

About 84% of the formula amount of the water is added to a suitable mixer, such as a vertical cylindrical tank equipped with heating and cooling means and connected to a discharge pump, the formula amounts of polyphosphate and carbonate (of particle sizes that pass a No. 160 sieve) are added, with stirring (by a Lightnin type mixer), followed by the CMC, and the anionic detergents are next admixed, after which the other components are admixed in any suitable order. The balance of the water is added, thinning the mix, and the perfume is then added, with mixing, and the product is ready to be pumped out of the mixer and into end use narrow necked bottles, which serve as dispensing containers. During the mixing operation, all of which takes about nine minutes, the materials added and the final product are at a temperature of about 20° C. In some cases, to promote faster dissolving and quicker dispensing of the components, the temperature of the water and other components charged may be raised to 40° to 50° C., so that the final product temperature may be about 30° C. to 40° C., in which case the mixing time may be reduced to about 5 or 6 minutes.

The liquid detergent resulting (at room temperature) has a viscosity of about 1,550 cps. and pours satisfactorily from a plastic detergent bottle with a discharge opening of about 2.5 cm. It has a pH of about 10.5. The liquid detergent is employed to wash a mixed load of soiled laundry, some of which includes cotton swatches and polyester/cotton swatches soiled with particulate soil and with sebum soil. The liquid detergent is added to the tub of a standard washing machine with about one-half cup of the liquid detergent being employed per wash (to make the concentration of liquid detergent in wash water about 0.18%). The temperature of the wash water is 21° C. (to test the "cold" water washing capabilities of the product) and the water is of a mixed calcium and magnesium hardness of about 150 p.p.m. as $CaCO_3$. After washing of the laundered items and the test swatches they are either "line dried" or machine dried (in a conventional laundry dryer).

The same operations as described above are repeated for a control detergent formulation wherein the sodium polyacrylate is omitted, being replaced by water.

Both the experimental composition (that containing sodium polyacrylate) and the control composition are excellent fabric softening detergents but the experimental product is far superior in one important characteristic, maintenance of a satisfactory viscosity on storage. Thus, after five days the viscosity of the experimental product is 2,580 cps. whereas that of the control is 9,400 cps.; after 14 days the viscosities are 3,400 cps. and 13,500 cps., respectively; after 21 days the viscosities are 3,500 cps. and 14,500 cps., respectively; and after 28 days they are 4,050 and 18,500 cps., respectively. At 4,050 cps. the product is still pourable from the bottle but at 18,500 cps. it is not pourable and must be shaken or stirred so as to be dispensable. Subsequent to 28 days after manufacture the viscosity of the experimental formula does not increase significantly and any increase in viscosity of the control is not of great significance because over 18,000 cps. the product is unmarketable anyway.

From the experiment it is evident that the presence of a very small proportion of sodium polyacrylate significantly helps to stabilize the viscosity of the described detergent compositions on storage,which effect was not previously recognized by the art.

The experimental liquid detergent is of an attractive light blue uniform appearance and on storage does not settle into different layers of materials.

In addition to being useful as a detergent for machine washing,the product of the present invention may be employed in hand washing of laundry and as a liquid for pretreatment of excessively soiled areas of laundry. In hand washing of laundry, to promote maximum deposition of bentonite on the laundry and thereby to improve the softening effects thereof, the washing solution is allowed to drain out of the washtub through a bottom drain so that it passes through the laundry, after which the laundry may be rinsed in normal manner. When employed as a pre-treatment for soiled areas of laundry the liquid detergent is preferably applied full strength (although dilutions may also be used) to soiled areas and is rubbed into them. During such application and rubbing the bentonite assists the detergent in loosening and removing the soil, whether it be oily or particulate soil, and at the same time some of the bentonite adheres to the fibers of the material of the laundry, thus helping to soften laundry material at such location. Such softening of the material may contribute to lesser soiling of the area and lesser soil retention in the future, especially when the soiled areas are shirt cuffs or collars.

EXAMPLE 2

A liquid detergent like that of Example 1 is formulated, using 9% of a linear dodecylbenzene sulfonate in place of the 8.8% of linear tridecylbenzene sulfonate, 2% of sodium alkyl polyethoxy sulfate wherein the alkyl is of 12 to 13 carbon atoms and the polyethoxy is of an average of 6.5 ethoxy groups, instead of the 2.2% of that previously employed, 0.2% of Alcosperse 107 (solids content basis) instead of Alcosperse 107D (used in Example 1), 11% of the STPP, 6% of sodium carbonate, 15% of bentonite (Mineral Colloid 101), the adjuvants previously mentioned and 55.7% of city water of 100 p.p.m. hardness, as $CaCO_3$. The additional sodium carbonate improves the miscibility of the various components during the manufacturing procedure and the replacement of the detergents does not significantly adversely affect the properties of the product. The product is made in essentially the same manner as previously described.

The liquid detergent is a stable pourable liquid having the desirable cleaning and softening properties described for the liquid detergent of Example 1, whether used for machine washing or hand washing of laundry or for pretreatments thereof. The viscosity thereof does not exceed 5,000 cps. after a month's storage at room temperature.

Similarly, acceptable liquid detergents are made when 3% of sodium lauryl alcohol sulfate, 2% of Neodol 23-6.5 and 0.5% of silicone anti-foam oil are incorporated in the product by addition to the components of Example 1 (replacing water). Also when sodium citrate or potassium citrate is employed to replace the sodium carbonate (or when only partial replacements of such material, e.g., 30% replacements, are effected with such citrates or trisodium nitrilotriacetate) useful liquid detergents will result, having desirable properties, like those of the compositions previously described.

EXAMPLE 3

A liquid detergent like that of Example 1 is made but only 2% of sodium carbonate is employed in the formulation, with the water content being increased correspondingly. Although the sodium carbonate content is decreased the mix is still processable to a final product of desirable properties, which is useful as a heavy duty laundry detergent for washing cotton and synthetic materials and softening them, and is also useful as a pre-treatment for such laundry. When 0.5% of sodium carboxymethyl cellulose is added to the formula in place of part of the water thereof improved whitening of the laundry is obtained such as by changing the sodium polyacrylate content to 0.12 to 0.18%, without substantial loss of softening power due to the anti-redeposition activity of the CMC.

In other variations of the invention, when the proportions of the various components of the liquid detergent of Example 1 are changed ±10% or ±20%, without going outside the ranges given in this specification, stable, pourable liquid detergents of useful cleaning and softening effects result. In some such products it may be desirable to include as much as 10% of Zeolite A or up to 4% of sodium silicate of $Na_2O:SiO_2$ ratio of about 1:2.4, although the silicate will often be avoided, and if the zeolite is present, to avoid depositing of zeolite-silicate aggregates or reaction products, the silicate will normally be omitted.

As is seen from the preceding description and the working example, the fabric softening heavy duty liquid detergents of this invention are stable, uniform, attractive and functional. Despite the presence of a substantial proportion of gelling agent (bentonite) in a liquid medium, they do not form objectionable gels and they remain pourable during storage. Also, despite lengthy storage, during which the suspended bentonite is subjected to intimate contact with surface active agents and inorganic salt builders in an aqueous medium, the bentonite does not objectionably agglomerate and its softening action on laundry is not destroyed. By using the mentioned detergents and builders in an aqueous medium in which sodium polyacrylate is also present, there is produced a liquid detergent which, despite the content of a substantial proportion of bentonite of the swelling type, remains liquid and pourable and retains its physical and chemical characteristics,which allow it to be deposited on the laundry and act as a lubricant for the fibers thereof, thereby promoting softening of such laundry. Also, as was previously mentioned, by employment of the liquid medium the possibility that the bentonite would be deactivated by overheating, as in a spray drying tower, is obviated.

The present liquid detergents, in addition to being useful as products for machine and hand washing of laundry, are also good for pre-treatments of stained portions of laundry, in which treatments it is considered that the bentonite content assists in removing the stains and in softening the stained area (and the product is also subsequently employed for washing purposes). Thus, from the foregoing recitation of the properties and advantages of the present invention it is seen that it represents a significant advance in the detergent composition art because it allows convenient employment of a non-gelling liquid detergent to both clean and soften laundry (and to pre-treat it) while utilizing excellent anionic synthetic organic detergents and not having to incorporate with such anionic detergents adversely chemically reactive cationic materials, such as quaternary ammonium salts, for their softening action. Furthermore, the bentonites employed are not ecologically harmful, as the quaternary ammonium salts might be, and do not cause buildups of objectionable fatty deposits on laundry, which often can cause it to look discolored, as the quaternaries sometimes do.

While the sodium salts and sodium compounds of the various components of the present liquid detergents have been described because they are especially satisfactory and are commercially available, the corresponding potassium compounds may be substituted for them, at least in part, and are also within this invention. Thus, potassium detergents, potassium builder salts, potassium bentonites and potassium adjuvant salts can be used and such are intended to be included with sodium compounds as "alkali metal" compounds in the formulas given.

The invention has been described with respect to various embodiments and working examples but is not to be limited to these because it is evident that one of skill in the art, with the present specification before him, will be able to utilize substitutes and equivalents without departing from the invention.

What is claimed is:

1. A fabric softening heavy duty liquid detergent composition of a density in the range of 1.15 to 1.35 g./ml. at room temperature, a pH in the range of 9.5 to 11, and a viscosity in the range of 1,000 to 5,000 centipoises, which does not increase to more than 5,000 centipoises on thirty days quiescent storage at room temperature, which comprises 6 to 12% of sodium linear higher alkylbenzene sulfonate wherein the higher alkyl is of 12 to 15 carbon atoms, 1.5 to 3% of sodium alkyl polyethoxy sulfate wherein the alkyl is of 12 to 16 carbon atoms and the polyethoxy is of 2 to 7 ethylene oxide groups, 7 to 15% of sodium tripolyphosphate, 2 to 7% of sodium carbonate, 8 to 15% of finely divided swelling bentonite, 0.12 to 0.18% fo sodium polyacrylate of molecular weight in the range of 1,000 to 3,000, and 50 to 70% of water.

2. A heavy duty liquid composition according to claim 1, the viscosity of which does not increase to more than 5,000 centipoises on 30 days quiescent storage at room temperature, which comprises 6 to 12% of sodium linear higher alkylbenzene sulfonate wherein the higher alkyl is of 12 to 15 carbon atoms, 1.5 to 3% of sodium alkyl polyethoxy sulfate wherein the alkyl is of 12 to 16 carbon atoms and the polyethoxy is of 2 to 7 ethylene oxide groups, 7 to 15% of sodium tripolyphosphate, 2 to 7% of sodium carbonate, 8 to 15% of finely divided bentonite, 0.12 to 0.18% of sodium polyacrylate of molecular weight in the range of 1,000 to 3,000, and 50 to 70% of water.

3. A liquid detergent according to claim 2 which comprises 8 to 10% of sodium linear higher alkylbenzene sulfonate of 12 to 13 carbon atoms in the alkyl group, 1.7 to 2.7% of sodium alkyl polyethoxy sulfate wherein the alkyl is of 12 to 15 carbon atoms and the polyethoxy is of 3 to 5 ethylene oxide groups, 9 to 13% of sodium tripolyphosphate, 3 to 6% of sodium carbonate, 10 to 14% of finely divided bentonite, of dry and unswelled particle size of about No. 325, U.S. Sieve Series, 0.12 to 0.18% of sodium polyacrylate of molecular weight in the range of 1,500 to 2,500, and 55 to 70% of water.

4. A liquid detergent according to claim 3 which comprises about 9% of sodium linear tridecylbenzene sulfonate, about 2% of sodium alkyl polyethoxy sulfate wherein the alkyl is of 12 to 15 carbon atoms and the polyethoxy is of about 3 ethylene oxide groups, about 11% of sodium tripolyphosphate, about 4% of sodium carbonate, about 12% of bentonite, about 0.15% of sodium polyacrylate of molecular of about 2,000, and about 60% of water.

5. A liquid detergent according to claim 4 which comprises about 0.2% of sodium carboxymethyl cellulose and about 0.2% of formalin, and in which the water is deionized water, the density is about 1.25 g./ml. and the pH is about 10.5.

6. A fabric softening heavy duty liquid detergent composition of a density in the range of 1.15 to 1.35 g./ml. at room temperature, a pH in the range of 9.5 to 11, and a viscosity in the range of 1,000 to 5,000 centipoises, which does not increas to more than 6,000 centipoises on 30 days quiescent storage at room temperature, which comprises 6.5 to 20% of water soluble synthetic organic detergent of the anionic sulfonated and/or sulfated type, 5 to 25% of water soluble builder salt for the detergent(s), 5 to 20% of swelling bentonite, 0.12 to 0.18% of sodium polyacrylate of molecular weight in the range of 1,000 to 5,000, and 40 to 75% of water.

7. A fabric softening heavy duty liquid detergent according to claim 1, comprising about 9% of sodium linear tridecylbenzene sulfonate, about 2% of sodium higher linear alkyl triethoxy sulfate, wherein the higher alkyl is of 12 to 15 carbon atoms, about 11% of sodium tripolyphosphate, about 4% of sodium carbonate, about 0.25 of sodium carboxymethyl cellulose, about 0.15% of sodium polyacrylate of a molecular weight of about 2,000, about 0.2% of formalin, about 12% of about No. 325 sieve bentonite, about 1.2% of adjuvants (pigment, fluorescent brightener and perfume), and about 60.2% of deionized water, which is of improved stability of viscosity on storage, compared to a control composition from which the sodium polyacrylate is omitted.

* * * * *